US011352580B2

(12) United States Patent
Kim et al.

(10) Patent No.: US 11,352,580 B2
(45) Date of Patent: Jun. 7, 2022

(54) MINERAL BASE OIL HAVING HIGH VISCOSITY INDEX AND IMPROVED VOLATILITY AND METHOD OF MANUFACTURING SAME

(71) Applicants: SK INNOVATION CO., LTD, Seoul (KR); SK LUBRICANTS CO., LTD., Seoul (KR)

(72) Inventors: Hak Mook Kim, Daejeon (KR); Kang Min Jung, Daejeon (KR); Kyung Seok Noh, Daejeon (KR); Yong Rae Cho, Daejeon (KR)

(73) Assignees: SK INNOVATION CO., LTD, Seoul (KR); SK LUBRICANTS CO., LTD., Seoul (KR)

( * ) Notice: Subject to any disclaimer, the term of this patent is extended or adjusted under 35 U.S.C. 154(b) by 0 days.

(21) Appl. No.: 16/748,978

(22) Filed: Jan. 22, 2020

(65) Prior Publication Data

US 2020/0291321 A1 Sep. 17, 2020

(30) Foreign Application Priority Data

Mar. 14, 2019 (KR) ..... 10-2019-0029268

(51) Int. Cl.

| | |
|---|---|
| ***C10G 7/06*** | (2006.01) |
| ***C10G 73/02*** | (2006.01) |
| ***C10G 73/44*** | (2006.01) |
| ***C10M 101/02*** | (2006.01) |
| ***C10G 53/02*** | (2006.01) |
| ***C10M 177/00*** | (2006.01) |
| *C10N 30/00* | (2006.01) |
| *C10N 30/02* | (2006.01) |

(52) U.S. Cl.

CPC ..... *C10M 101/02* (2013.01); *C10G 53/02* (2013.01); *C10M 177/00* (2013.01); *C10M 2203/1006* (2013.01); *C10M 2203/1065* (2013.01); *C10N 2030/02* (2013.01); *C10N 2030/74* (2020.05)

(58) Field of Classification Search

CPC ..... C10G 7/06; C10G 73/02; C10G 73/44; C10G 2300/302; C10G 2300/308; C10G 2400/10

See application file for complete search history.

(56) References Cited

U.S. PATENT DOCUMENTS

| | | | | |
|---|---|---|---|---|
| 3,382,291 | A | 5/1968 | Brennan | |
| 3,742,082 | A | 6/1973 | Brennan | |
| 4,172,855 | A | 10/1979 | Shubkin et al. | |
| 4,894,145 | A * | 1/1990 | Jensen | B01D 3/4244 202/160 |
| 4,994,168 | A * | 2/1991 | Harandi | C10G 7/00 208/100 |
| 5,726,134 | A * | 3/1998 | Adams | C10M 163/00 508/391 |
| 6,599,864 | B1 * | 7/2003 | Bertomeu | C10M 101/02 208/18 |
| 2005/0236301 | A1 * | 10/2005 | Adams | C10M 107/02 208/92 |
| 2007/0278134 | A1 | 12/2007 | Timken et al. | |
| 2009/0149357 | A1 * | 6/2009 | McGeehan | C10M 107/02 508/110 |

FOREIGN PATENT DOCUMENTS

| | | | |
|---|---|---|---|
| JP | 2000319682 | A | 11/2000 |
| JP | 2007016172 | A | 1/2007 |
| JP | 2014237853 | A | 12/2014 |
| JP | 2106014149 | A | 1/2016 |
| KR | 1020020052180 | A | 7/2000 |
| KR | 1020099020079 | A | 2/2009 |
| KR | 1020110133130 | A | 12/2011 |
| KR | 1020150139356 | A | 12/2015 |
| KR | 1020170084887 | A | 7/2017 |

OTHER PUBLICATIONS

Examination Report of the Korean Patent Office dated Aug. 7, 2019, in corresponding Korean Patent Application No. 10-2019-0029268.

* cited by examiner

*Primary Examiner* — Randy Boyer

(74) *Attorney, Agent, or Firm* — Abelman, Frayne & Schwab; Stefan Knirr

(57) ABSTRACT

Disclosed is a mineral base oil including 85 to 92 wt % of a paraffinic hydrocarbon and 8 to 15 wt % of a naphthenic hydrocarbon and having a Noack volatility of 10 to 12 wt % and a viscosity index of 132 to 142.

6 Claims, 1 Drawing Sheet

MINERAL BASE OIL HAVING HIGH VISCOSITY INDEX AND IMPROVED VOLATILITY AND METHOD OF MANUFACTURING SAME

CROSS-REFERENCE TO RELATED APPLICATION

This application claims the benefit of Korean Patent Application No. 10-2019-0029268, filed Mar. 14, 2019, entitled "Mineral based base oil having high viscosity index and improved volatility and manufacturing method of the same", which is hereby incorporated by reference in its entirety into this application.

BACKGROUND OF THE DISCLOSURE

1. Technical Field

The present disclosure relates to a mineral base oil having a high viscosity index and improved volatility and a method of manufacturing the same.

2. Description of the Related Art

Base oil is a raw material for lubricant products. Generally, excellent base oil has a high viscosity index, superior stability (for oxidation, heat, UV, etc.) and low volatility. The American Petroleum Institute (API) classifies base oils depending on the quality thereof, as shown in Table 1 below.

TABLE 1

| Classification | Sulfur (%) | Saturate (%) | VI (Viscosity Index) |
|---|---|---|---|
| Group I | >0.03 | <90 | 80 to 120 |
| Group II | ≤0.03 | ≥90 | 80 to 120 |
| Group III | ≤0.03 | ≥90 | 120 or more |
| Group IV | All polyalphaolefins (PAOs) | | |
| Group V | All other base oils not included in Group I, II, III, or IV | | |

In general, among mineral base oils, base oils manufactured by a solvent extraction process mainly correspond to Group I, base oils manufactured by a hydroprocessing and catalytic dewaxing mostly correspond to Group II, and base oils having a high viscosity index manufactured by an advanced hydroprocessing and catalytic dewaxing mainly correspond to Group III. A lubricant is composed of a base oil and an additive. In response to fuel economy regulations worldwide, there is increasing demand for lubricants with high performance (e.g. high fuel efficiency and long life). In order to manufacture high-performance lubricants, it is essential to ensure base oils having properties and performance of certain levels or higher. Polyalphaolefin (PAO) base oils having superior volatility and low-temperature viscosity are mainly used for the production of high-performance lubricants.

Polyalphaolefin is typically prepared by polymerizing alphaolefin in the range of 1-octene to 1-dodecene, with 1-decene being the preferred material. PAO may be prepared through polymerization of an olefin feed in the presence of a catalyst such as $AlCl_3$, $BF_3$ or $BF_3$ complex. The preparation of PAO is disclosed, for example, in U.S. Pat. Nos. 3,382,291, 4,172,855, and 3,742,082.

PAO has good performance, but is expensive and raises the cost of lubricants. There is thus a need for economic production of mineral base oils having improved volatility and a high viscosity index capable of replacing PAO.

SUMMARY OF THE DISCLOSURE

Accordingly, a first aspect of the present disclosure is to provide a mineral base oil having improved volatility and a high viscosity index.

A second aspect of the present disclosure is to provide a lubricant product including the base oil according to the first aspect.

A third aspect of the present disclosure is to provide a method of manufacturing the base oil according to the first aspect.

Therefore, an embodiment of the present disclosure for accomplishing the first aspect provides a mineral base oil, including 85 to 92 wt % of a paraffinic hydrocarbon and 8 to 15 wt % of a naphthenic hydrocarbon and having a Noack volatility of 10 to 12 wt % and a viscosity index of 132 to 142.

In an exemplary embodiment of the present disclosure, the mineral base oil may be derived from a distillate of an unconverted oil having a boiling point ranging from 410 to 430° C. as D5 wt % (a 5 wt % distillation point) and a boiling point ranging from 450 to 470° C. as D95 wt % (a 95 wt % distillation point).

In an exemplary embodiment of the present disclosure, the mineral base oil may have a specific gravity (60/60° F.) of 0.815 to 0.835.

In an exemplary embodiment of the present disclosure, the mineral base oil may have a kinematic viscosity of 3.9 cSt to 4.4 cSt at 100° C.

In an exemplary embodiment of the present disclosure, the amount of a hydrocarbon having 25 to 32 carbon atoms in the mineral base oil may be 85 wt % or more based on the total weight of the mineral base oil.

Another embodiment of the present disclosure for accomplishing the second aspect provides a lubricant product, including 10 to 85 wt % of the base oil according to the first aspect.

In an exemplary embodiment of the present disclosure, the lubricant product may further include 5 to 25 wt % of a detergent inhibitor (DI) package, 1 to 15 wt % of a viscosity modifier, and 0.1 to 5 wt % of a pour point depressant.

In an exemplary embodiment of the present disclosure, the lubricant product does not contain synthetic base oil.

In an exemplary embodiment of the present disclosure, the lubricant product does not contain polyalphaolefin (PAO) or ester base oil.

Still another embodiment of the present disclosure for accomplishing the third aspect provides a method of manufacturing a base oil, including providing an unconverted oil, subjecting the unconverted oil to vacuum distillation, thus separating a distillate having a boiling point range including D5 wt % (a 5 wt % distillation point) of 410 to 430° C. and D95 wt % (a 95 wt % distillation point) of 450 to 470° C., and subjecting the distillate separated through vacuum distillation to catalytic dewaxing, thus obtaining a base oil including 85 to 92 wt % of a paraffinic hydrocarbon and 8 to 15 wt % of a naphthenic hydrocarbon.

In an exemplary embodiment of the present disclosure, the catalytic dewaxing may be performed under conditions of a reaction temperature of 250 to 410° C., a reaction pressure of 30 to 200 $kg/cm^2$ g, a liquid hourly space velocity (LHSV) of 0.1 to 3.0 $hr^{-1}$ and a hydrogen-to-feed volume ratio of 150 to 1000 $Nm^3/m^3$.

In an exemplary embodiment of the present disclosure, the distillate separated through vacuum distillation may have a viscosity index of 145 to 160, a sulfur content of 50 ppm or less, and a nitrogen content of 30 ppm or less.

According to the present disclosure, a mineral base oil has improved volatility and a high viscosity index and is thus capable of replacing PAO. In addition, the method of the present disclosure makes it possible to economically manufacture a mineral base oil having improved volatility and a high viscosity index capable of replacing PAO.

DESCRIPTION OF SPECIFIC EMBODIMENTS

Figure 1:
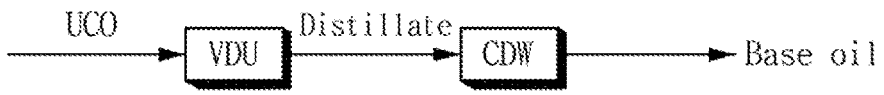
FIG. 1 schematically shows a process of manufacturing a base oil according to an embodiment of the present disclosure.

FIG. 1 schematically shows a process of manufacturing a base oil according to an embodiment of the present disclosure. As shown in FIG. 1, the method of manufacturing a base oil according to an embodiment of the present disclosure includes providing an unconverted oil, subjecting the unconverted oil to vacuum distillation, thus separating a distillate having a boiling point ranging from 410 to 430° C. as D5 wt % (a 5 wt % distillation point) and a boiling point ranging from 450 to 470° C. as D95 wt % (a 95 wt % distillation point), and subjecting the distillate separated through vacuum distillation to catalytic dewaxing, thus obtaining a base oil including 85 to 92 wt % of a paraffinic hydrocarbon and 8 to 15 wt % of a naphthenic hydrocarbon and having a Noack volatility of 10 to 12 wt %, a viscosity index of 132 to 142, a specific gravity (60/60° F.) of 0.815 to 0.835, and a kinematic viscosity of 3.9 cSt to 4.4 cSt at 100° C.

(a) Providing Unconverted Oil

As used in the present disclosure, the term "unconverted oil (UCO)" refers to oil that has been fed to a hydrocracking process for fuel oil production but has not been converted into light fuel oil.

Useful in an embodiment of the present disclosure is unconverted oil having a viscosity index (VI) of 145 to 160, preferably 147 to 155, and more preferably 145 to 153, a sulfur content of 0 to 50 ppmw, preferably 0.1 to 30 ppmw, and more preferably 0.1 to 10 ppmw, and a nitrogen content of 0 to 30 ppmw, preferably 0.1 to 7 ppmw, and more preferably 0.1 to 5 ppmw.

If the viscosity index of the unconverted oil is less than 145, it is impossible to manufacture a base oil having a high viscosity index of 130 or more, and if the sulfur content is greater than 50 ppmw and/or the nitrogen content is greater than 30 ppmw, the lifetime of the catalyst used in subsequent processes may be lowered, leading to decreased reaction efficiency.

Figure 2:
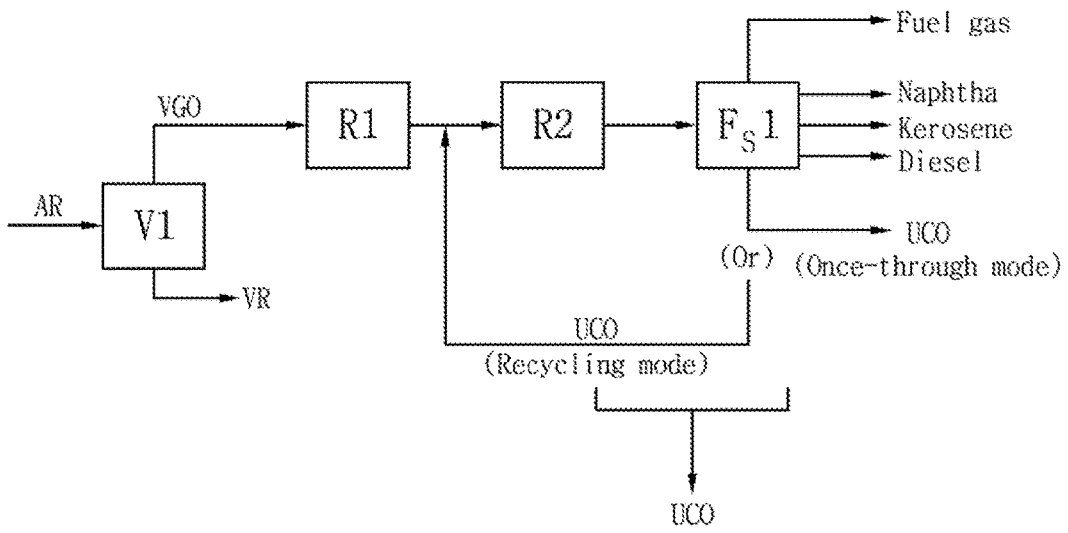
FIG. 2 schematically shows a process of manufacturing an unconverted oil according to an embodiment of the present disclosure.

FIG. 2 schematically shows a process of manufacturing the unconverted oil according to an embodiment of the present disclosure.

Generally, a fuel hydrocracker process is a process of hydrocracking an atmospheric residue (AR), particularly a vacuum gas oil (VGO) obtained through vacuum distillation of a heavy hydrocarbon mixture (V1). The fuel hydrocracker process includes a hydrotreating reaction process (R1), which is a pretreatment process for removing metal components and hetero compounds containing sulfur, nitrogen, oxygen, and the like, which are impurities included in the vacuum gas oil (VGO), in order to protect the catalyst for the hydrocracking process (R2), which is the main reaction process. Next, the vacuum gas oil undergoes a hydrocracking reaction process (R2), as the main reaction process, in which unsaturated hydrocarbons such as aromatic compounds or olefin compounds in the vacuum gas oil are added with hydrogen and thus converted into naphthene compounds or paraffin compounds, which are saturated hydrocarbons, and some of the naphthene compounds, which are cyclic saturated hydrocarbons, may be ring-opened and thus converted into paraffin compounds, which are linear hydrocarbons. These compounds may also be cracked into smaller compounds, and a series of such processes may be called hydrocracking, through which light hydrocarbon mixtures, that is, light fuel oils, are obtained.

The oil and hydrogen, having undergone the two-step reaction process, are subjected to a separation unit to remove the hydrogen, and the hydrogen is recycled, and the oil is commercialized by separating various light fuel oils and gases converted through the first fractional distillation process (Fs1). Here, the conversion rate of the vacuum gas oil, which is heavy oil, into light fuel oil, is generally set to about 50 to 90% per pass through the reactor. Operation to a conversion rate of 100% per pass is impossible in practice, so the unconverted oil (UCO) is always generated during the last fractional distillation stage. The unconverted oil is treated in a once-through mode to transfer the same to the tank as it is or in a recycling mode to increase the overall conversion rate by recycling the same to the hydrocracking process. Here, the hydrotreating and hydrocracking reactions are typically carried out in a fixed-bed reactor packed with a catalyst at a high temperature under a high hydrogen partial pressure. Therefore, most of the aromatic compounds and heterocyclic compounds containing sulfur, nitrogen, and oxygen elements contained in the vacuum gas oil as the feed are saturated with hydrogen, whereby the amounts of aromatics and sulfur, nitrogen, and oxygen compounds are remarkably decreased. The unconverted oil that is not converted into light fuel oil during the hydrocracking reaction is oil in which aromatic and hetero compounds, which are undesirable components in the base oil, are contained in small amounts, and the unconverted oil has viscosity suitable for use in the base oil, and thus such unconverted oil is imparted with appropriate fluidity and stability, thereby manufacturing a base oil having high quality. The representative properties of the unconverted oil are shown in Table 2 below.

TABLE 2

| | Vacuum gas oil | UCO1 | UCO2 |
|---|---|---|---|
| Specific gravity @ 15/4° C. | 0.922 | 0.835 | 0.865 |
| Kinematic viscosity @40° C., cst | 49.9 | 19.3 | 21.1 |
| Pour point, ° C. | 32.5 | 40.0 | 37.5 |
| Distillation properties, ° C. | | | |
| Initial boiling point (IBP) | 260 | 350 | 327 |
| 10% off | 372 | 385 | 375 |
| 50% off | 444 | 435 | 436 |
| 90% off | 516 | 496 | 500 |
| Final boiling point (FBP) | 547 | 536 | 550 |
| Sulfur content, ppm | 800 | <2 | <2 |

The process of manufacturing the unconverted oil is disclosed in Korean Patent Application Publication No.

1994-0026185 and Korean Patent No. 0877004, the entire content of which is incorporated herein by reference.

(b) Vacuum Distillation

The unconverted oil is passed through a vacuum distillation unit (VDU) in order to obtain a distillate for manufacturing a base oil having intended volatility and viscosity. The unconverted oil is separated into at least one distillate through the VDU.

In an embodiment of the present disclosure, the vacuum distillation may be performed under conditions of a bottom temperature of 290 to 350° C., a bottom pressure of 60 to 100 mmHg, an overhead temperature of 60 to 90° C. and an overhead pressure of 50 to 90 mmHg.

In the unconverted oil separated through vacuum distillation, the distillate, having a narrow boiling point range, such as D5 wt % of 410 to 430° C. and D95 wt % of 450 to 470° C., preferably D5 wt % of 415 to 430° C. and D95 wt % of 450 to 465° C., and more preferably D5 wt % of 415 to 425° C. and D95 wt % of 455 to 465° C., is fed to a catalytic dewaxing process. Distillate having distillation properties outside of the above narrow range may be transferred into hydrocracking or other upgrade units and may thus be utilized. D5 wt % corresponds to a 5 wt % distillation point, D95 wt % corresponds to a 95 wt % distillation point, and the boiling point range may be determined in accordance with ASTM D1160.

If D5 wt % is lower than 410° C., the volatility of base oil products may deteriorate. On the other hand, if D5 wt % is higher than 430° C., the yield of base oil products may decrease. If D95 wt % is lower than 450° C., the yield of base oil products may decrease. On the other hand, if D95 wt % is higher than 470° C., the addition of light oil is inevitable in order to meet the target kinematic viscosity, and thus the volatility of base oil products may deteriorate.

Figure 3:
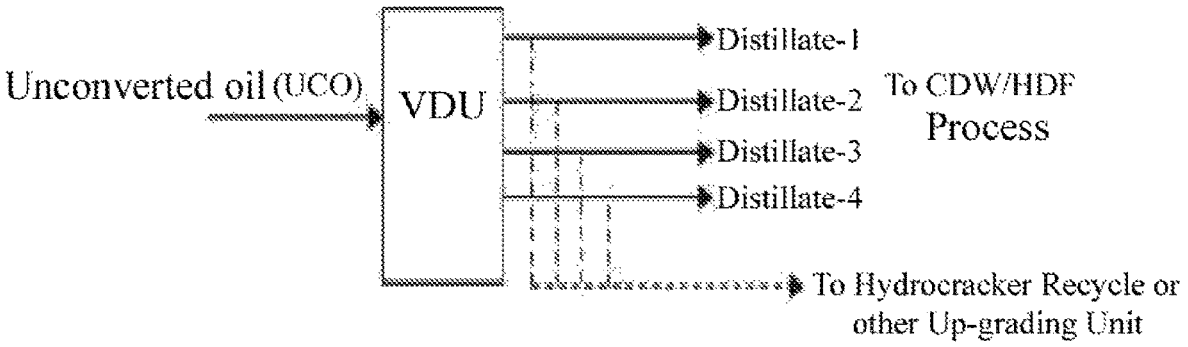
FIG. 3 schematically shows the separation of a distillate in a vacuum distillation process.

FIG. 3 schematically shows the separation of the distillate in the vacuum distillation process. The distillate having the above narrow boiling point range among the distillate produced through vacuum distillation is introduced to a subsequent dewaxing process, and oil fractions, which are unsuitable for the purpose of the present disclosure, may be introduced to other upgrade processes. The oil resulting from vacuum distillation may be continuously introduced to subsequent processes, or may be stored in a separate tank for later use.

(c) Catalytic Dewaxing

The catalytic dewaxing reaction selectively isomerizes the wax component of the hydrocracked residue to thus convert normal-paraffin into iso-paraffin, thereby improving the low-temperature properties (ensuring low pour point) thereof.

In an embodiment of the present disclosure, the catalytic dewaxing may be performed under conditions of a reaction temperature of 250 to 410° C., a reaction pressure of 30 to 200 $kg/cm^2$ g, a liquid hourly space velocity (LHSV) of from 0.1 to 3.0 $hr^{-1}$ and a hydrogen-to-feed volume ratio of from 150 to 1000 $Nm^3/m^3$.

The catalyst used herein is mainly a bifunctional catalyst. The bifunctional catalyst is configured to include two active components, that is, a metal site for hydrogenation/dehydrogenation and a carrier having an acid site for skeletal isomerization through carbenium ions. The catalyst of a zeolite structure is typically configured to include an aluminosilicate carrier and at least one metal selected from among Group 8 metals and Group 6 metals.

The catalytic dewaxing catalyst usable in the present disclosure may include a carrier having an acid site selected from among a molecular sieve, alumina and silica-alumina, and at least one metal having a hydrogenation function selected from among elements in Groups 2, 6, 9 and 10 of the periodic table. In particular, among Group 9 and 10 (i.e. Group VIII) metals, Co, Ni, Pt and Pd are preferably used, and among Group 6 (i.e. Group VIB) metals, Mo and W are preferably used.

Examples of the carrier having an acid site may include a molecular sieve, alumina, silica-alumina, etc. Here, the molecular sieve may be crystalline aluminosilicate (zeolite), SAPO, or ALPO, and examples of a medium-pore molecular sieve having a 10-membered oxygen ring may include SAPO-11, SAPO-41, ZSM-11, ZSM-22, ZSM-23, ZSM-35, ZSM-48, etc., and a large-pore molecular sieve having a 12-membered oxygen ring may be used.

In an embodiment of the present disclosure, the base oil may include a paraffinic hydrocarbon in an amount of 85 wt % to 92 wt %, 86 wt % to 91 wt %, 87 wt % to 90 wt %, or any range or sub-range therebetween. Also, the base oil according to an embodiment of the present disclosure may include a naphthenic hydrocarbon in an amount of 8 wt % to 15 wt %, 9 wt % to 14 wt %, 10 wt % to 13 wt %, or any range or sub-range therebetween.

PAO base oil and GTL base oil may include about 99 wt % of a paraffinic hydrocarbon, whereas the base oil according to the present disclosure is a mineral base oil derived from crude oil, and includes 85 wt % to 92 wt % of a paraffinic hydrocarbon. If the amount of the paraffinic hydrocarbon is less than 85 wt %, the oxidation stability of the base oil may be lowered. On the other hand, if the amount thereof exceeds 92 wt %, compatibility with some additives in the manufacture of lubricant products may be deteriorated.

In the base oil of the present disclosure, the amount of the hydrocarbon species in the base oil has a significant effect on the properties of the base oil. More specifically, when the amount of the paraffinic hydrocarbon in the base oil increases, lubrication performance may increase, oxidation stability and thermal stability may be improved, and the ability to maintain viscosity depending on changes in temperature is improved, but flowability at low temperatures is reduced. Also, when the amount of the aromatic hydrocarbon in the base oil increases, compatibility with the additive may be improved, but oxidation stability and thermal stability may be deteriorated and harmfulness may increase. Also, when the amount of the naphthenic hydrocarbon in the base oil increases, compatibility with the additive and flowability at low temperatures may be improved, but oxidation stability and thermal stability may be deteriorated. Meanwhile, in the present disclosure, the amount of each hydrocarbon in the base oil is measured by the composition analysis method specified in ASTM D2140.

Noack volatility indicates the evaporation loss of oil under high-temperature conditions (e.g. 250° C.). Noack volatility may be determined in accordance with ASTM D5800. Higher volatility means increased oil consumption. A conventional mineral base oil (e.g. YUBASE 4 plus) has Noack volatility of about 13.2 wt %. If the Noack volatility of the base oil is greater than 12 wt %, the evaporation loss of lubricants made from base oil is inferior, resulting in shortened lubricant drain interval. In contrast, the base oil according to an embodiment of the present disclosure may have Noack volatility of 10 to 12 wt %. It is considered that the low Noack volatility of the present disclosure is due to the production of the base oil from the distillate in which hydrocarbons are distributed in the narrow boiling point range.

The viscosity index is a measure of change in viscosity depending on the temperature. The case in which the viscosity change depending on temperature is low is defined as high viscosity index. The base oil has to have a high viscosity index in order to ensure good startability at low temperatures and to maintain an oil film at high temperatures. The viscosity index may be determined in accordance with ASTM D2270. A conventional mineral base oil (e.g. YUBASE 4 plus) has a viscosity index of about 131. In contrast, the base oil according to an embodiment of the present disclosure may have a viscosity index of 132 to 142, preferably 134 to 140, and more preferably 135 to 139.

The base oil according to the present disclosure may have an aniline point of 115 to 120° C., and preferably 117 to 119° C. The aniline point refers to the lowest temperature at which the hydrocarbon completely dissolves in the same volume of aniline and is a numerical value representing the solubility of the hydrocarbon. The aniline point may be measured in accordance with classification 6031 of the Korean Industrial Standard KSM 5000 Test Method.

The base oil according to an embodiment of the present disclosure may have a specific gravity (60/60° F.) of 0.815 to 0.835, preferably 0.822 to 0.829, and more preferably 0.824 to 0.828. The specific gravity (60/60° F.) means the weight ratio of oil at 60° F. to the same volume of pure water at 60° F. The specific gravity does not directly affect the performance of the base oil, but it is possible to infer the composition of paraffin, naphthene, and aromatics on the basis of the molecular weight (On the basis of the molecular weight, the specific gravity is higher in the order of paraffin<naphthene<aromatics).

If the specific gravity is greater than 0.835, the amount of paraffin is low and thus thermal/oxidation stability may become relatively poor. On the other hand, if the specific gravity is less than 0.815, the amount of paraffin is high and thus compatibility with additives may become relatively poor. The specific gravity may be determined in accordance with ASTM D1298.

The base oil according to an embodiment of the present disclosure may have a kinematic viscosity at 100° C. of 3.9 to 4.4 cSt, preferably 3.9 to 4.3 cSt, and more preferably 4.0 to 4.3 cSt. The kinematic viscosity is a value obtained by dividing the viscosity of a fluid by the density of the fluid. In general, "viscosity" of a base oil refers to kinematic viscosity, and the measurement temperatures are set to 40° C. and 100° C. according to the viscosity classification based on the International Organization for Standardization (ISO). The kinematic viscosity may be determined in accordance with ASTM D445.

The base oil of the present disclosure may have a kinematic viscosity at 100° C. of 3.9 cSt to 4.4 cSt. Thus, when the base oil according to the present disclosure is applied to engine oil products, low-viscosity engine oils may be produced.

In an embodiment of the present disclosure, the amount of hydrocarbon having 25 to 32 carbon atoms in the base oil may be 85 wt % to 100 wt %, preferably 86 wt % to 99 wt %, and more preferably 87 wt % to 98 wt %, based on the total weight of the mineral base oil. If the amount of hydrocarbon molecule having 25 to 32 carbon atoms in the base oil is less than 85 wt % based on the total weight of the base oil, the carbon number distribution may be widened, thus deteriorating volatility or low-temperature performance.

(d) Hydrofinishing

In an embodiment of the present disclosure, the dewaxed oil may optionally be introduced to a hydrofinishing process.

The hydrofinishing process is a step to ensure stability by removing olefin and polyaromatics of dewaxed oil depending on the product requirements in the presence of a hydrofinishing catalyst, and to finally control the aromatic content and gas hygroscopicity. Typically, this process is performed under conditions of a temperature of from 150 to 300° C., a pressure of from 30 to 200 kg/cm$^2$, an LHSV of from 0.1 to 3 hr$^{-1}$ and a hydrogen-to-feed volume ratio of from 300 to 1500 Nm$^3$/m$^3$.

The catalyst used in the hydrofinishing process is provided in the form of a metal supported on a carrier, and the metal includes at least one metal having a hydrogenation function selected from among Group 6, 8, 9, 10 and 11 elements, and preferably metal sulfide series of Ni—Mo, Co—Mo or Ni—W or noble metals such as Pt and Pd.

In addition, as a carrier for the catalyst used in the hydrofinishing process, silica, alumina, silica-alumina, titania, zirconia or zeolite having a large surface area may be used, and preferably alumina or silica-alumina is used. The carrier functions to improve the hydrogenation performance by increasing the dispersibility of the metal, and it is very important to control the acid site in order to prevent cracking and coking of the product.

(e) Lubricant Product

In an embodiment of the present disclosure, a lubricant product including the base oil in an amount of 10 to 85 wt %, 30 to 80 wt %, 50 to 75 wt %, or any range or sub-range there between may be manufactured. The amount of the base oil according to the present disclosure may be variously adjusted depending on the end use and purpose of the lubricant product. The base oil according to the present disclosure may be used in appropriate combination with other mineral base oil products in order to meet desired product specifications.

In an embodiment of the present disclosure, the lubricant product may not contain synthetic base oil. For example, the lubricant product does not contain PAO or ester base oil. By using the base oil according to the present disclosure, rather than using expensive PAO or ester base oil, it is possible to manufacture lubricant products that meet product specifications.

In an embodiment of the present disclosure, the lubricant product may further include an additive. The additive may be, for example, a DI package, an antioxidant, a detergent, a dispersant, an antifoaming agent, a viscosity modifier, a viscosity index improver, an extreme pressure agent, a pour point depressant, a corrosion inhibitor, or an emulsifier. However, the additive is not limited thereto so long as it is generally added to lubricant products.

The lubricant product may further include, for example, 5 to 25 wt %, 10 to 20 wt %, or 15 to 18 wt % of a DI package, 1 to 15 wt %, 3 to 13 wt %, or 5 to 10 wt % of a viscosity modifier, and 0.1 to 5 wt %, 1 to 4 wt %, or 2 to 3 wt % of a pour point depressant.

The lubricant product may be used in a field or environment in which low volatility is required, and it is possible to replace the lubricant product manufactured with conventional PAO or ester base oil. The lubricant product may be, for example, automotive engine oil, but is not limited thereto.

A better understanding of the present disclosure will be given through the following examples, which are not to be construed as limiting the scope of the present disclosure.

EXAMPLE 1

An unconverted oil having a viscosity index (VI) of 148 to 151, a sulfur content of 20 ppmw or less, and a nitrogen content of about 5 ppmw or less was subjected to vacuum distillation, thus obtaining a distillate having a kinematic viscosity of about 4.2 cSt (100° C.), a viscosity index of about 155, D5 wt % of about 420° C., and D95 wt % of about 450° C. The distillate was subjected to catalytic dewaxing, thereby manufacturing a novel base oil according to the present disclosure. In the catalytic dewaxing step, Pt/zeolite was used as an isomerization catalyst. The reaction was carried out under conditions of a reaction pressure of 150 to 160 kg/cm$^2$ g, LHSV of 1.0 to 2.0 hr$^{-1}$, and a hydrogen-to-oil ratio of 400 to 600 Nm$^3$/m$^3$. The reaction temperature fell in the range of about 340 to 360° C. During operation, the reaction temperature was adjusted such that the pour point of the catalytic dewaxing reaction effluent fell in the range of −15 to 21° C.

COMPARATIVE EXAMPLE 1

A conventional mineral base oil (YUBASE 4 plus) was manufactured in the same manner as in Example 1, with the exception that a distillate having D5 wt % of about 390° C. and D95 wt % of about 470° C. was used as the distillate upon catalytic dewaxing.

The properties of the novel base oil and the conventional base oil including YUBASE 4 plus are shown in Table 3 below.

TABLE 3

| | YUBASE 4 plus | PAO | GTL | Novel base oil |
|---|---|---|---|---|
| Kinematic viscosity (100° C.), cSt | 4.16 | 4.04 | 4.05 | 4.20 |
| Viscosity index | 133 | 124 | 129 | 138 |
| Noack volatility, wt % | 13.5 | 14.0 | 12.5 | 11.5 |
| Paraffin content, wt % | 84 | 99 | 99 | 88 |
| Aniline point, ° C. | 118 | 121 | 122 | 118 |

Improved Noack Volatility

Noack volatility of the novel base oil was vastly superior among base oils having similar viscosity grades. Compared to the conventional mineral base oil (YUBASE 4 plus) having a boiling point range wider than the boiling point range defined in the present invention, the novel base oil met the volatility specification of European passenger car engine oil (0W-16 grade) (Table 6 of Example 4).

As the Noack volatility value of the novel base oil decreases, lubricant consumption is expected to decrease, and there is an effect of decreasing the amount of carbide deposits caused by the volatilized lubricant in actual use.

High Viscosity Index

The novel base oil had a viscosity index of 130 or more, and was the greatest among base oils having similar viscosity grades. As the viscosity index of the base oil increases, fuel efficiency is improved when the lubricant is manufactured.

Price Competitiveness

The novel base oil is a mineral base oil, and the manufacturing cost thereof is low compared to PAO produced through synthesis.

Difference in Composition

PAO and GTL include 99 wt % or more of paraffin, whereas the novel base oil, which is a mineral base oil, includes about 87 wt % of paraffin and about 13 wt % of naphthene. Thereby, the novel base oil of the present invention has an aniline point of 118° C., lower than that of PAO and GTL. Meanwhile, conventional Group III+ mineral base oils, such as YUBASE 4 plus, contain about 84 wt % of paraffin, which is less than the base oil of the present invention.

EXAMPLE 2

European passenger car engine oil (0W-30 grade) was manufactured by adding each of the novel base oil of Example 1 and PAO with an additive. The properties thereof are shown in Table 4 below.

TABLE 4

| | | PAO (existing formulation) | Novel base oil | specification |
|---|---|---|---|---|
| Base oil | YUBASE 4 plus | 30.9 | — | |
| | YUBASE 6 | 20.0 | 5.0 | |
| | PAO 4 | 30.0 | — | |
| | Novel base oil | — | 75.4 | |
| Additive | DI package | 13.3 | 13.3 | |
| | VM *1 | 5.5 | 5.5 | |
| | PPD *2 | 0.3 | 0.3 | |
| Properties | Kinematic viscosity (100° C.), cSt | 10.1 | 10.0 | 9.3 to 12.5 |
| | HTHS viscosity *3 (150° C.), cP | 3.0 | 3.0 | 2.9 to 3.5 |
| | Noack volatility, wt % | 10.0 | 10.0 | Max. 10.0 |
| | CCS viscosity *4 (−35° C.), cP | 5980 | 6010 | Max. 6200 |

*1 VM = Viscosity Modifier
*2 PPD = Pour Point Depressant
*3 HTHS viscosity = Viscosity Measured under High-Temperature High-Shear Conditions
*4 CCS viscosity = Cold Cranking Simulator Viscosity It was possible to design an engine oil formulation that meets the corresponding specification using the novel base oil without using PAO.

EXAMPLE 3

European passenger car engine oil (0W-20 grade) was manufactured by adding each of the novel base oil of Example 1 and PAO with an additive. The properties thereof are shown in Table 5 below.

TABLE 5

| | | PAO (existing formulation) | Novel base oil | specification |
|---|---|---|---|---|
| Base oil | PAO 4 | 75.5 | — | |
| | Novel base oil | — | 75.5 | |
| Additive | DI pkg. | 12.2 | 12.2 | |
| | VM | 11.0 | 11.0 | |
| | PPD | 0.3 | 0.3 | |
| | Other additives | 1.0 | 1.0 | |

TABLE 5-continued

| | | PAO (existing formulation) | Novel base oil | specification |
|---|---|---|---|---|
| Properties | Kinematic viscosity (100° C.), cSt | 8.19 | 8.557 | 6.9 to 9.3 |
| | Viscosity index | 185 | 193 | — |
| | Noack volatility, wt % | 10.1 | 10.0 | Max. 11.0 |
| | CCS viscosity (−35° C.), cP | 3250 | 4700 | Max. 6200 |

It was possible to design an engine oil formulation that meets the corresponding specification using the novel base oil without using PAO.

EXAMPLE 4

European passenger car engine oil (0W-16 grade) was manufactured by adding each of the novel base oil of Example 1 and YUBASE 4 plus base oil with an additive. The properties thereof are shown in Table 6 below.

TABLE 6

| | | YUBASE 4 plus | Novel base oil | specification |
|---|---|---|---|---|
| Base oil | YUBASE 4 plus | 78.5 | — | |
| | Novel base oil | — | 78.5 | |
| Additive | DI pkg. | 18.0 | 18.0 | |
| | VM | 3.3 | 3.3 | |
| | PPD | 0.2 | 0.2 | |
| Properties | Kinematic viscosity (100° C.), cSt | 7.17 | 7.15 | 6.1 to 8.2 |
| | HTHS viscosity (150° C.), cP | 2.4 | 2.4 | 2.3 to 2.6 |
| | Noack volatility, wt % | 12.1 | 10.0 | Max. 11.0 |
| | CCS viscosity (−35° C.), cP | 5480 | 5540 | Max. 6200 |

When applying the novel base oil, it was confirmed that Noack volatility decreased compared to when applying the existing mineral base oil.

Although the embodiments of the present disclosure have been disclosed for illustrative purposes, those skilled in the art will appreciate that various modifications, additions and substitutions are possible, without departing from the scope and spirit of the disclosure as disclosed in the accompanying claims.

Accordingly, simple modifications or variations of the present disclosure fall within the scope of the present disclosure as defined in the accompanying claims.

What is claimed is:

1. A method of manufacturing a base oil, comprising:

providing an unconverted oil;

subjecting the unconverted oil to vacuum distillation, thus separating a distillate having D5 wt % of 415 to 425° C. and D95 wt % of 455 to 465° C., wherein D5 wt % is a 5 wt % distillation point and D95 wt % is a 95 wt % distillation point; and subjecting the distillate separated through vacuum distillation to catalytic dewaxing, thus obtaining a base oil comprising greater than or equal to 85 and less than 90 wt % of a paraffinic hydrocarbon and 8 to 15 greater than 10 and less than or equal to 15 wt % of a naphthenic hydrocarbon, wherein the base oil has a Noack volatility of 10 to 12 wt % and an aniline point of 115 to 120° C.

2. The method of claim 1, wherein the distillate separated through vacuum distillation has a viscosity index of 145 to 160, a sulfur content of 50 ppm or less, and a nitrogen content of 30 ppm or less.

3. The method of claim 1, wherein the base oil has a a viscosity index of 132 to 142.

4. The method of claim 1, wherein the base oil has a specific gravity (60/60° F.) of 0.815 to 0.835.

5. The method of claim 1, wherein the base oil has a kinematic viscosity of 3.9 cSt to 4.4 cSt at 100° C.

6. The method of claim 1, wherein an amount of a hydrocarbon having 25 to 32 carbon atoms in the base oil is 85 wt % or more based on a total weight of the mineral base oil.

* * * * *